US008602955B2

(12) United States Patent
Bryan

(10) Patent No.: US 8,602,955 B2
(45) Date of Patent: Dec. 10, 2013

(54) FURNACE ROLLER ASSEMBLY

(75) Inventor: Patrick H. Bryan, Eighty Four, PA (US)

(73) Assignee: Andritz Bricmont Inc., Canonsburg, PA (US)

( * ) Notice: Subject to any disclaimer, the term of this patent is extended or adjusted under 35 U.S.C. 154(b) by 815 days.

(21) Appl. No.: 12/725,121

(22) Filed: Mar. 16, 2010

(65) Prior Publication Data

US 2010/0239991 A1 Sep. 23, 2010

Related U.S. Application Data

(60) Provisional application No. 61/160,806, filed on Mar. 17, 2009.

(51) Int. Cl.
*B21B 27/02* (2006.01)
*F27D 3/02* (2006.01)

(52) U.S. Cl.
USPC ..... 492/46; 492/35; 492/43; 492/44; 219/647; 219/216; 432/236; 432/246

(58) Field of Classification Search
USPC ..... 492/35, 43, 44, 46; 219/647, 653, 216; 432/236, 60, 228, 246
See application file for complete search history.

(56) References Cited

U.S. PATENT DOCUMENTS 3,103,346 A * 9/1963 Buckholdt et al. ..... 432/236
3,750,211 A * 8/1973 Zaun et al. ..... 15/3.11
3,860,387 A 1/1975 Bricmont
4,363,163 A * 12/1982 McMaster ..... 226/190
4,991,276 A 2/1991 Bricmont
5,230,618 A 7/1993 Bricmont et al.
5,341,568 A 8/1994 Bricmont et al.
5,362,230 A 11/1994 Facco
5,382,159 A 1/1995 Bricmont
5,448,040 A 9/1995 Deplano et al.
5,529,486 A 6/1996 Bricmont
5,833,455 A 11/1998 Carr
5,863,197 A * 1/1999 Boy et al. ..... 432/236
6,039,681 A * 3/2000 Heinz-Michael ..... 492/20
6,259,071 B1 7/2001 Demidovitch et al.
6,426,969 B2 * 7/2002 Fontana ..... 373/20
6,435,867 B1 8/2002 Carr et al.
D466,597 S 12/2002 Carr
6,619,471 B1 * 9/2003 Downie et al. ..... 198/780
2007/0180884 A1 8/2007 Pankiw et al.

FOREIGN PATENT DOCUMENTS

EP 635691 A1 * 1/1995
GB 429626 6/1935

* cited by examiner

*Primary Examiner* — David Bryant
*Assistant Examiner* — Jason L Vaughan
(74) *Attorney, Agent, or Firm* — Nixon & Vanderhye, P.C.

(57) ABSTRACT

A furnace roller assembly is provided with a helically shaped shaft-offset and metal product contact surface assembly wound around a furnace roller shaft. A corebuster may be provided within the furnace roller shaft to direct the flow of a coolant within the axial length of the furnace roller shaft and through a cooling element forming a part of the shaft-offset and metal contact surface assembly.

25 Claims, 6 Drawing Sheets

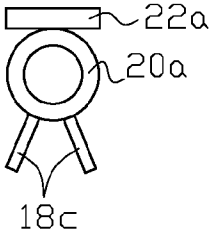
FIG. 5
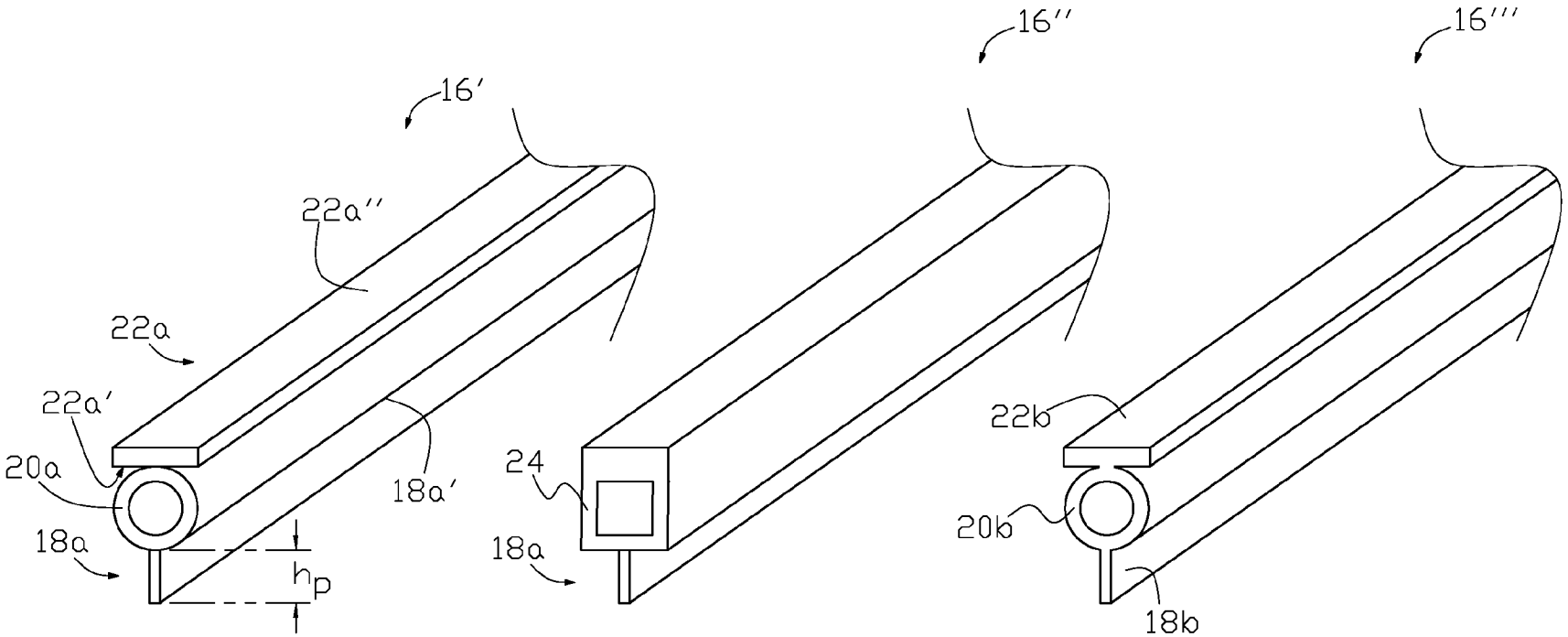
FIG. 2(c)
FIG. 2(b)
FIG. 2(a)

FURNACE ROLLER ASSEMBLY

CROSS REFERENCE TO RELATED APPLICATIONS

This application claims the benefit of U.S. Provisional Application No. 61/160,806, filed Mar. 17, 2009, hereby incorporated by reference in its entirety.

FIELD OF THE INVENTION

The present invention relates to a roller assembly used in a furnace to move metal product through the furnace by rotating the roller assembly so that metal product sitting on the roller assembly advances through the furnace.

BACKGROUND OF THE INVENTION

A furnace roller assembly, or furnace roll or roller, is used to move a metal product through a furnace. Typically the metal product is a flat sheet, or slab, that travels along the length of the furnace by making surface contact with structural elements attached to each furnace roller assembly installed along the length of the furnace. U.S. Pat. No. 5,833,455 relates various types of furnaces, including roller hearth tunnel furnaces, and the metal products moving through the furnaces in the description of the prior art. The furnace roller assembly rotates by connection to a suitable drive that may include a motor, and is typically cooled by internal water flow.

The radially outward surface of the rim of a metallic tire is typically used in a furnace roller as the structural element making friction contact with metal product, as shown for example, in U.S. Pat. Nos. 5,230,618 and 5,341,568 where multiple tires are spaced apart from each other along the arbor, or shaft, of the furnace roller. In these arrangements the shaft is oriented perpendicular to the direction of the metal product moving through the furnace, and the radially outward surfaces of the rims are parallel to the direction of the moving metal product.

As mentioned in the description of related art in U.S. Pat. No. 6,435,867 B1, the structural interface between a tire and the arbor (or shaft) of the furnace roller is critical to designing a furnace tire that will withstand the harsh furnace operating environment. Furnace tire life is a function of temperature of the metal product passing over the rim of the tire; metal product heating may be limited based upon the requirement to maintain a minimum service life for each installed tire. Further tire tracking, or skid marks, can result on the metal product from the fixed position of each tire's rim relative to the length of the metal product as it passes through the furnace. Depending upon the use of the product leaving the furnace, further processing of the product may be required to remove the tire tracking.

One objective of the present invention is to provide a method of moving metal product through a tunnel roller furnace with fewer limitations on the maximum temperature of the product based upon furnace roller life.

Another objective of the present invention is to provide a furnace roller that will not leave tire tracks, or other blemishes, on the product as it passes through the furnace.

BRIEF SUMMARY OF THE INVENTION

In one aspect the present invention is a furnace roller assembly and method of constructing a furnace roller assembly. The roller assembly is provided with a helically shaped shaft-offset and metal product contact surface assembly wound around a hollow shaft that can have an interior corebuster to provide a cooling medium flow path through the shaft and a cooling element forming a part of the shaft-offset and metal product contact surface assembly.

In another aspect the present invention is a furnace roller assembly comprising a shaft-offset and metal product contact surface assembly helically wound around the outer surface of a furnace roller shaft along the axial length of the furnace roller shaft. The shaft-offset and metal product contact surface assembly comprises: a wear element that is radially offset from the outer surface of the furnace roller shaft; a cooling element that is connected to the wear element; and a support element that is connected between the outer surface of the furnace roller shaft and the cooling element. The cooling element has an internal coolant passage that terminates at the cooling element's opposing ends at shaft supply and return coolant openings located along the axial length of the outer surface of the furnace roller shaft. The helically wound shaft-offset and metal product contact surface assembly may be counter wound about a central location on the outer surface of the furnace roller shaft towards the opposing axial ends of the furnace roller shaft. A drive, or other rotational means, can be attached to an end of the furnace roller shaft to rotate the furnace roller shaft and the helically wound shaft-offset and metal product contact surface assembly. In some examples of the invention, more than one shaft-offset and metal product contact surface assembly may be provided along the outer surface of the furnace roller shaft.

In some examples of the invention, the support element may be an elongated planar support plate having first and second opposing planar edges along the length of the support plate where the plane of the support plate extends radially from the outer surface of the furnace roller shaft. The first edge of the support plate may be continuously connected to the outer surface of the furnace roller shaft, and the second edge of the support plate may be continuously connected to the cooling element, which may be a tubular element. The wear element may be a planar wear bar that is connected to the cooling element so that a planar surface of the wear bar is radially offset from the outer surface of the furnace roller bar. In some examples of the invention, the support element may be an elongated V-shaped angle element with the ends of the extended legs of the V-shaped angle element connected to the outer surface of the furnace roller shaft, and with the joined ends of the V-shaped angled element connected to the cooling element. In some examples of the invention, the support element, cooling element and wear element may be integrally cast. In some examples of the invention the cooling element and wear element may be integrally formed. In some examples of the invention a thermal insulation is deposited over at least a portion of the outer surface of the furnace roller shaft.

In some examples of the invention, a corebuster is located within the furnace roller shaft and radially positioned relative to the interior surface of the furnace roller shaft to form a generally annular inter-volume between the outer surface of the corebuster and the inner surface of the furnace roller shaft. A continuous coolant flow can be formed through the shaft and corebuster. In some examples of the invention the continuous coolant path can be formed with a continuous coolant supply passage along the axial length of the furnace roller shaft in a first axial direction in communication with a continuous coolant return passage along the axial length of the furnace roller shaft in a second axial direction opposite the first axial direction. The shaft coolant inlet and outlet are located at the first axial end of the furnace roller shaft. The continuous coolant supply passage along the axial length of the furnace roller shaft in the first axial direction is formed from three segments. The first coolant supply passage segment is located within the interior of the corebuster and extends from the shaft coolant inlet to a first transition located radially adjacent to the offset assembly return coolant opening on the shaft, but is isolated from the offset assembly return coolant opening. The second coolant supply passage segment is located within the annular inter-volume extending from the first transition to a second transition located radially adjacent to the offset assembly supply coolant opening on the shaft, but is isolated from the offset assembly supply coolant opening. The third coolant supply passage segment is located within the interior of the corebuster extending from the second transition to the axial end of the furnace roller shaft opposing the first axial end of the furnace roller shaft. The continuous coolant return passage along the axial length of the furnace roller shaft in the second axial direction is formed from three segments. The first coolant return passage segment is located within the annular inter-volume and extends from the axial end of the furnace roller shaft opposing the first axial end of the furnace roller shaft to the offset assembly supply coolant opening. The second coolant return passage segment is within the cooling element and extends from the cooling element supply end to the cooling element return end. The third coolant return passage segment is within the annular inter-volume and extends from the offset assembly return coolant opening to the shaft coolant outlet.

In another aspect the present invention is a method of fabricating a furnace roller assembly. A linearly oriented elongated shaft-offset and metal contact surface assembly is fabricated from a wear, cooling and support element. The support element is connected to the cooling element, and the cooling element has an internal coolant passage terminating at opposing cooling element supply and return ends. Offset assembly supply and return coolant openings are formed along the length of a furnace roller shaft. The first ends of an offset assembly supply and return transition fittings are respectively connected to the offset assembly supply and return coolant openings. The linearly oriented shaft-offset and metal contact surface assembly is helically bended around the outer surface of the furnace roller shaft and the support element is connected to the outer surface of the furnace roller shaft. The second ends of the offset assembly supply and return transition fitting are respectively connected to the cooling element supply and return ends.

In another aspect, the present invention is a method of moving a metal product through a furnace. The axial lengths of at least two furnace roller assemblies are arranged in a furnace perpendicular to the direction of moving the metal product through the furnace. At least one of the two furnace roller assemblies comprises a furnace roller shaft and at least one shaft-offset and metal product contact surface assembly helically wound around the outer surface of the furnace roller shaft along the axial length of the furnace roller shaft. The at least one shaft-offset and metal product contact surface assembly comprises a wear element, a cooling element and a support element. The cooling element is connected to the wear element. The cooling element has an internal coolant passage terminating at opposing cooling element supply and return ends at an offset assembly supply and return coolant openings, respectively, located along the length of the furnace roller shaft. The support element is connected between the outer surface of the furnace roller shaft and the cooling element to radially offset the cooling element and wear element from the outer surface of the furnace roller shaft. Both of the at least two furnace roller assemblies are rotated to move the metal product over the at least two furnace roller assemblies in the furnace.

The above and other aspects of the invention are set forth in this specification and the appended claims.

BRIEF DESCRIPTION OF THE DRAWINGS

The foregoing brief summary, as well as the following detailed description of the invention, is better understood when read in conjunction with the appended drawings. For the purpose of illustrating the invention, there is shown in the drawings exemplary forms of the invention that are presently preferred; however, the invention is not limited to the specific arrangements and instrumentalities disclosed in the following appended drawings.

FIG. 2(*a*), FIG. 2(*b*) and FIG. 2(*c*), and FIG. 5 are alternative examples of a shaft-offset and metal product contact surface assembly used with the furnace roller assembly of the present invention.

FIG. 3(*b*) is a partial cross sectional elevation view along the longitudinal axis of the furnace roller assembly shown in FIG. 3(*a*) with illustration of thermal insulation utilized in some examples of the invention.

DETAILED DESCRIPTION OF THE INVENTION

Figure 1:
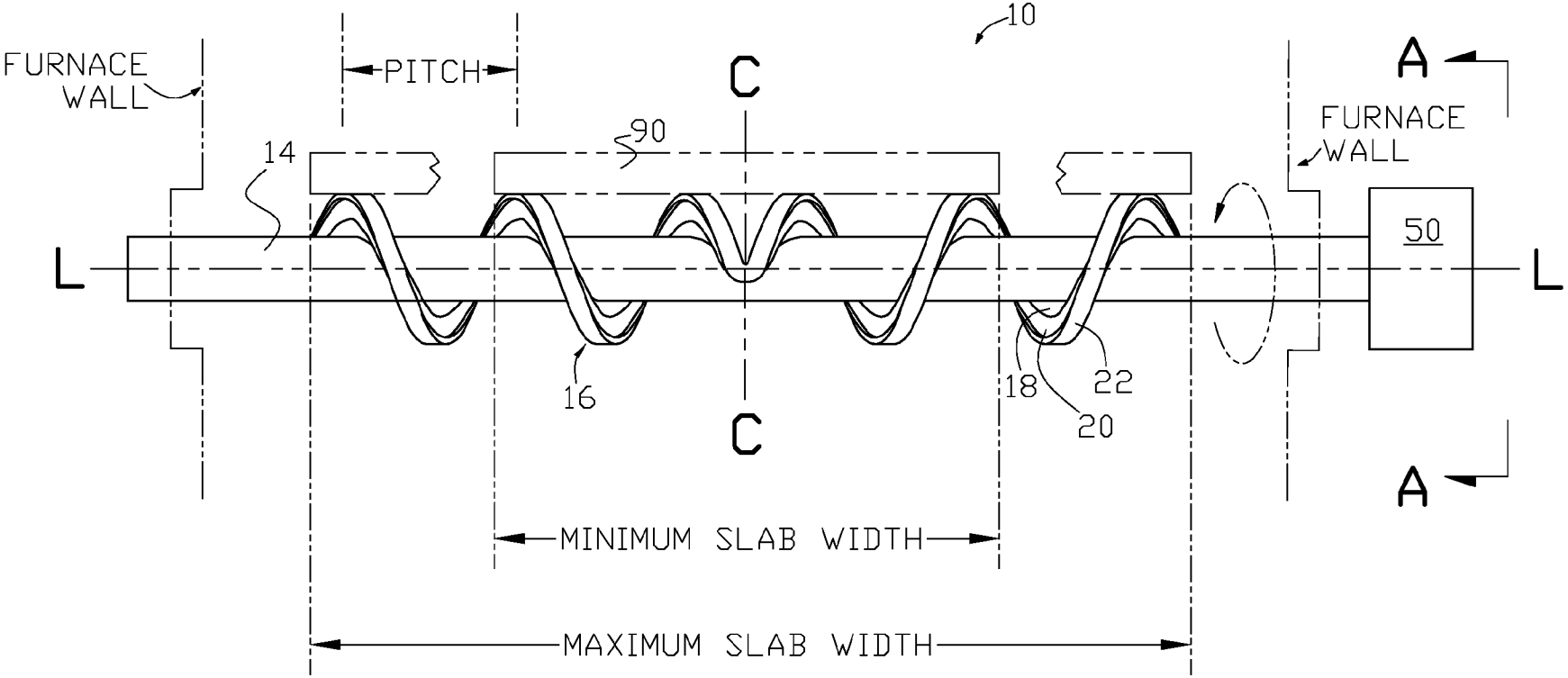
FIG. 1 is a front elevational view of one example of a furnace roller assembly of the present invention.
Figure 3A:
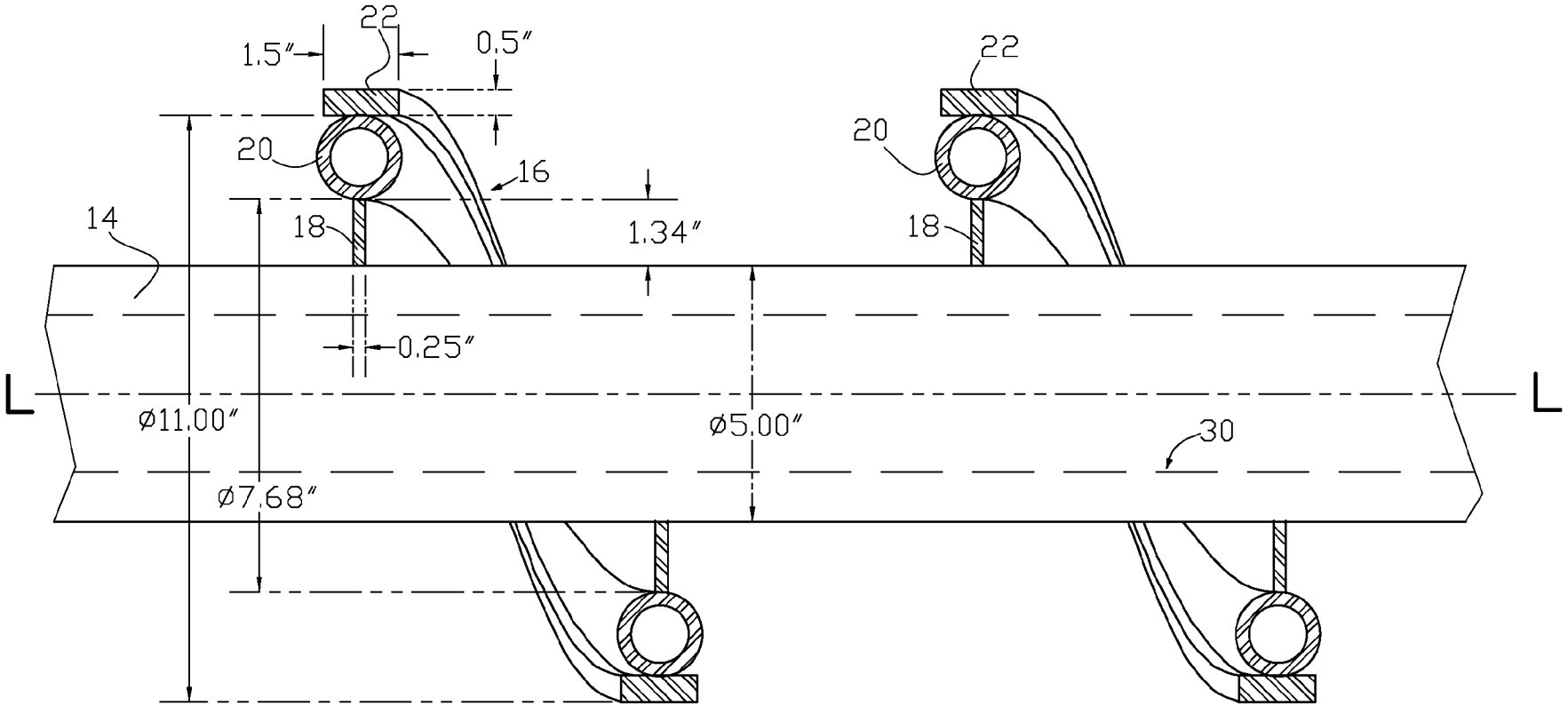
FIG. 3(*a*) is a partial cross sectional elevation view along the longitudinal axis L-L of the furnace roller assembly shown in FIG. 1 with illustration of typical dimensions utilized in one example of the invention.
Figure 3B:
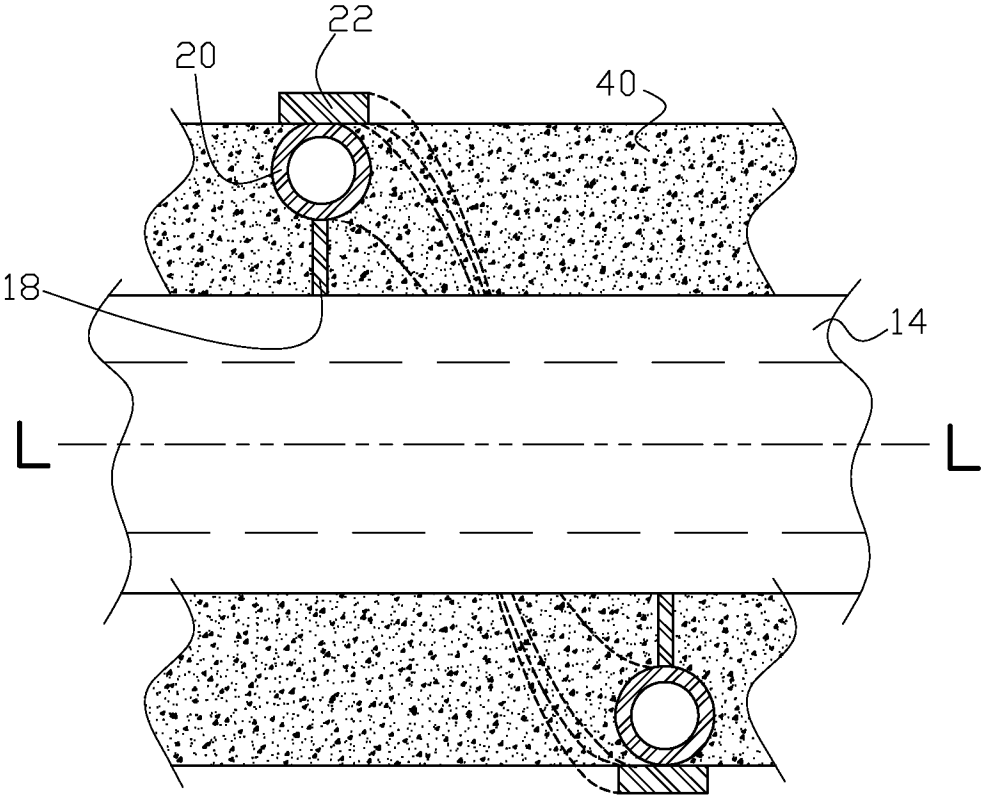

There is shown in FIG. 1 and FIG. 3(*a*) one non-exclusive example of a furnace roller assembly 10 of the present invention. Shaft-offset and metal product contact surface assembly 16 (offset assembly) comprises support element 18, cooling element 20 and wear element 22. Support element 18 is used primarily to provide an offset radial distance from the outer surface of shaft 14 to the surface on the wear element with which the metal product comes in friction contact with as the furnace roller assembly rotates. A suitable drive 50, including a motor, or other mechanical components, can be attached to at least one end of the furnace roller element as diagrammatically illustrated in FIG. 1 for rotation of the furnace roller assembly. Cooling element 20 is used primarily to provide a path for a cooling medium adjacent to the wear element. Wear element 22 is used primarily to provide a seating surface for frictional contact with the slab or metal product 90 (shown in dashed outline in FIG. 1) so that the furnace roller assembly advances the metal product through the furnace. Coolant can be supplied to cooling element 20 by any suitable method or as further described by the examples below. In the broadest aspect of the invention the cooling element may be of any shape that provides an internal coolant flow passage and support for the static and dynamic loading of the offset assembly when the metal product is seated on, or passes over the wear element.

As shown in FIG. 2(*a*), in one example of the invention, shaft-offset and metal product contact surface assembly 16' may be formed from elongated plate 18*a* (strip), upon which cylindrical pipe 20*a* is suitably attached, with wear bar 22*a* suitably attached to the top of the pipe. In some examples of the invention, a region of the outer surface of the cylindrical pipe may be continuously fillet welded along its length to edge 18*a*' of the plate and surface 22*a*' of the wear element may be continuously fillet welded along its length to an opposing region of the outer surface of the cylindrical pipe. Continuous fillet welding is preferred to maximize cooling of the wear bar. Plate 18*a* may be formed from carbon steel bar and have a suitable height $h_p$ (offset radial distance) as required to have wear surface 22*a*" at a desired distance above the outer surface of the shaft in a particular application. Pipe 20*a* may be formed from 1¼ NPS, schedule 160 or schedule 80 carbon steel. Wear bar 22*a* can be a medium carbon steel or high temperature chrome-nickel austenitic stainless steel, or other suitable high temperature material. In one particular application, support element 18 has a thickness of 0.25-inch and height of approximately 1.34 inches, and the wear element 22 is approximately 1.50 inches wide and 0.50-inch thick as shown in FIG. 3(*a*), with an outer shaft diameter of 5.00 inches.

Depending upon the particular application, support element 18*a* may not be a continuous plate along the entire length of the cooling tube; for example it may be formed as an open spoke structure. Alternatively the plate may also be similar to an inverted "V" shaped element 18*c* as shown in FIG. 5 where the diverging extended ends of the legs of the inverted "V" shaped element are connected to the outer surface of the furnace roller shaft and the converging ends of the legs of the inverted "V" shaped element are connected to the cooling tube or element. In the broadest aspect of the invention the support element may be of any shape that provides the required radial offset from the shaft, and support for the static and dynamic loading of the offset assembly when the metal product is seated on, or passes over, the wear element.

Alternatively the cooling and wear element may be combined into a single structural element such as rectangular pipe 24 in FIG. 2(*b*), which may optionally have an increased thickness (as shown in the figure) on the side of pipe 24 that will serve as the wear element and surface. Alternatively, as shown in FIG. 2(*c*), support element 18*b*, cooling element 20*b* and wear element 22*b* may be singularly formed, for example, as a continuous casting 16".

The linear shaft-offset and metal product contact surface assembly 16 can be formed helically around the outer diameter of shaft 14 as shown in FIG. 1 and suitably welded to the shaft. Alternatively assembly 16 may initially be wound around a mandrel and later installed on the shaft. In one embodiment of the invention, cooling element 20, support element 18 and wear element 22 can each be separately formed into a helix, and then suitably welded together and installed onto shaft 14 of the furnace roller assembly.

Preferably, but not by way of limitation, the shaft-offset and metal product contact surface assembly is helically counter-wound about a central location C-C along its axial length for approximately each half axial length of the shaft within the furnace as shown in FIG. 1; that is, the helix on one side of the central location is a right-handed helix, and the helix on the opposing side of the central location is a left-handed helix. This counter-wound helix arrangement will have the effect of the contact surface continuously moving outward along the axial length of the shaft until it is past the edge of the metal product. If the shaft-offset and metal contact surface assembly was helically wound in the same direction for the entire axial length of a single furnace roller shaft, one side would approach the edge of the metal product, which introduces the possibility of catching the edge of the product. If this happened at each roller, the edge of the metal product could become damaged during the travel through the furnace, or it could tend to push the metal product to one side. The helix in one non-exclusive example of the invention has approximately a 12 inch pitch. This will support a metal product up to about four inches thick without creating high contact pressure for the example in FIG. 3(*a*). In one non-exclusive example of the invention, with an outer shaft diameter of approximately five inches, a helical wear surface defined by a radial distance of six inches from the center of the shaft forms a twelve inch diameter roller assembly, as illustrated in FIG. 3(*a*).

In alternative examples of the invention, adjacent furnace roller assemblies may each have an offset assembly that is helically wound continuously in one direction for the entire axial length of the shaft, but helically counter-wound to each other (that is, one furnace roller assembly has a right-handed helix offset assembly and the adjacent roller has a left-handed helix offset assembly), to eliminate the damage mentioned above when multiple adjacent furnace roller assemblies are continuously wound with the same helical orientation.

While the width of the metal product, or slab, can vary with conventional furnace rollers having in-line tires as described above in the background of the invention, the product width must be of discrete widths so as to avoid product widths with edges near a furnace tire on the roller. With the helical wear bars utilized in the present invention, the metal product can be of any width above a minimum width generally defined by the pitch of the helix in a particular application since the support points (wear bar helical outer surface) are constantly changing. As noted in FIG. 1, for the particular non-exclusive helical configuration shown, the minimum slab width that can be accommodated is the sum of both 1.25 helix pitch counter-wound wear bars on each side of center C-C, and the maximum slab width is at least the entire length of the helical wear bar. As the roller assembly rotates, the helical configuration provides a pure translation movement; that is, perpendicular to the furnace roller's centerline. There is a line of contact between the metal product and the wear bar. This line of contact moves perpendicular to the furnace roller's axial centerline. The next line of contact on the helical wear bar is not directly in line with the first line of contact due to the helical configuration; however each line of contact moves in a straight motion.

The interior passage of each end of the helical cooling element 20 can be connected to the interior of the furnace roller's shaft for circulation of a coolant, such as water, through the cooling element. Coolant supply and return can be made at one end of the furnace roller's shaft through a duo flow rotary union. In one example of the invention, the coolant supply is introduced into the furnace roller assembly at one end of the shaft through a corebuster disposed within the shaft, which transmits the coolant to the opposing axial end of the furnace roller's shaft. A barrier plate in the corebuster diverts the return flow of the coolant to the interior volume between the inner diameter of the furnace roller's shaft and the outer diameter of the corebuster, and then exits through the rotary union.

Figure 4:
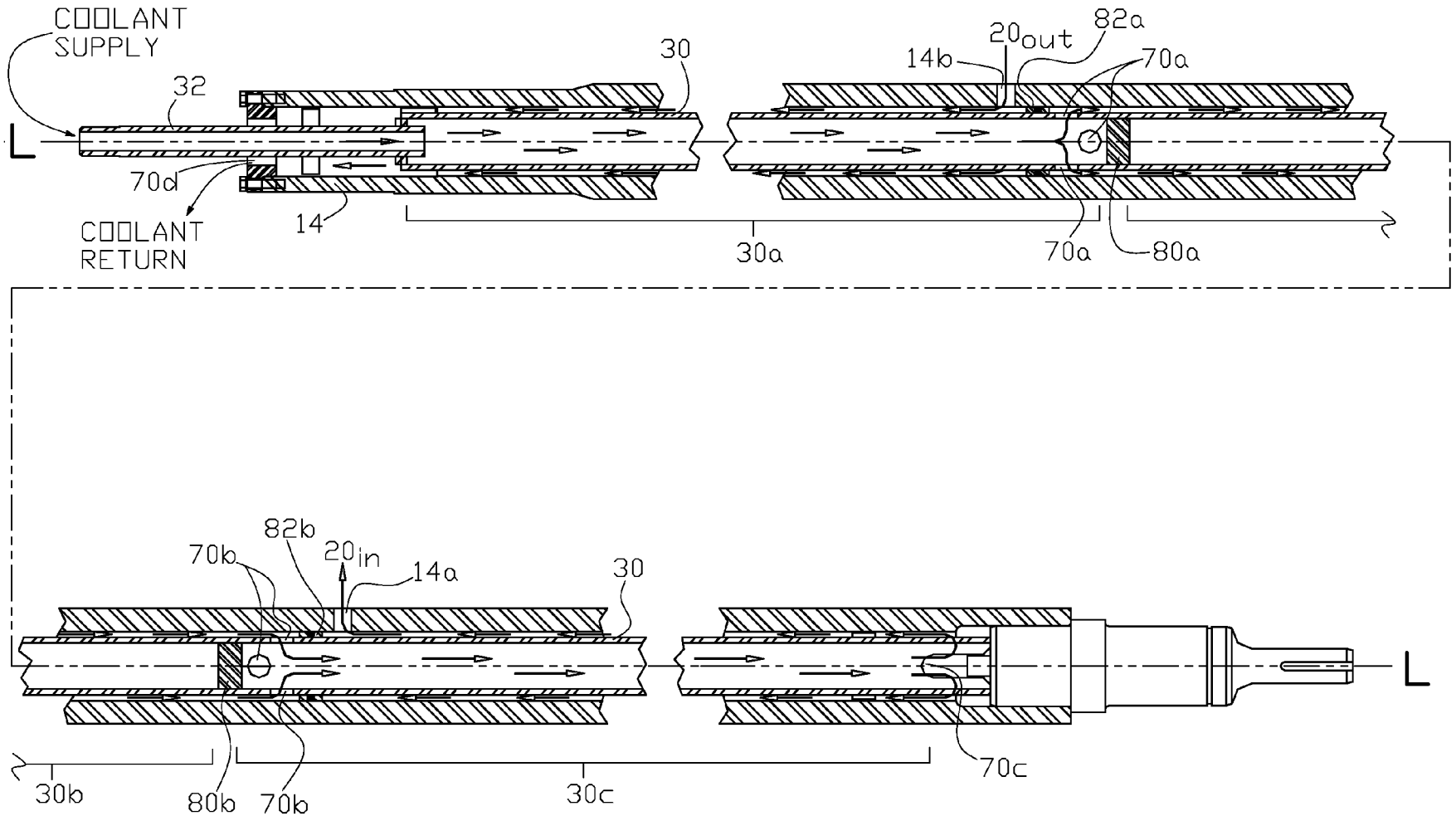
FIG. 4 is a cross sectional view of one example of a shaft and corebuster utilized with a furnace roller assembly of the present invention, and with internal coolant flow passages shown.
Figure 6:
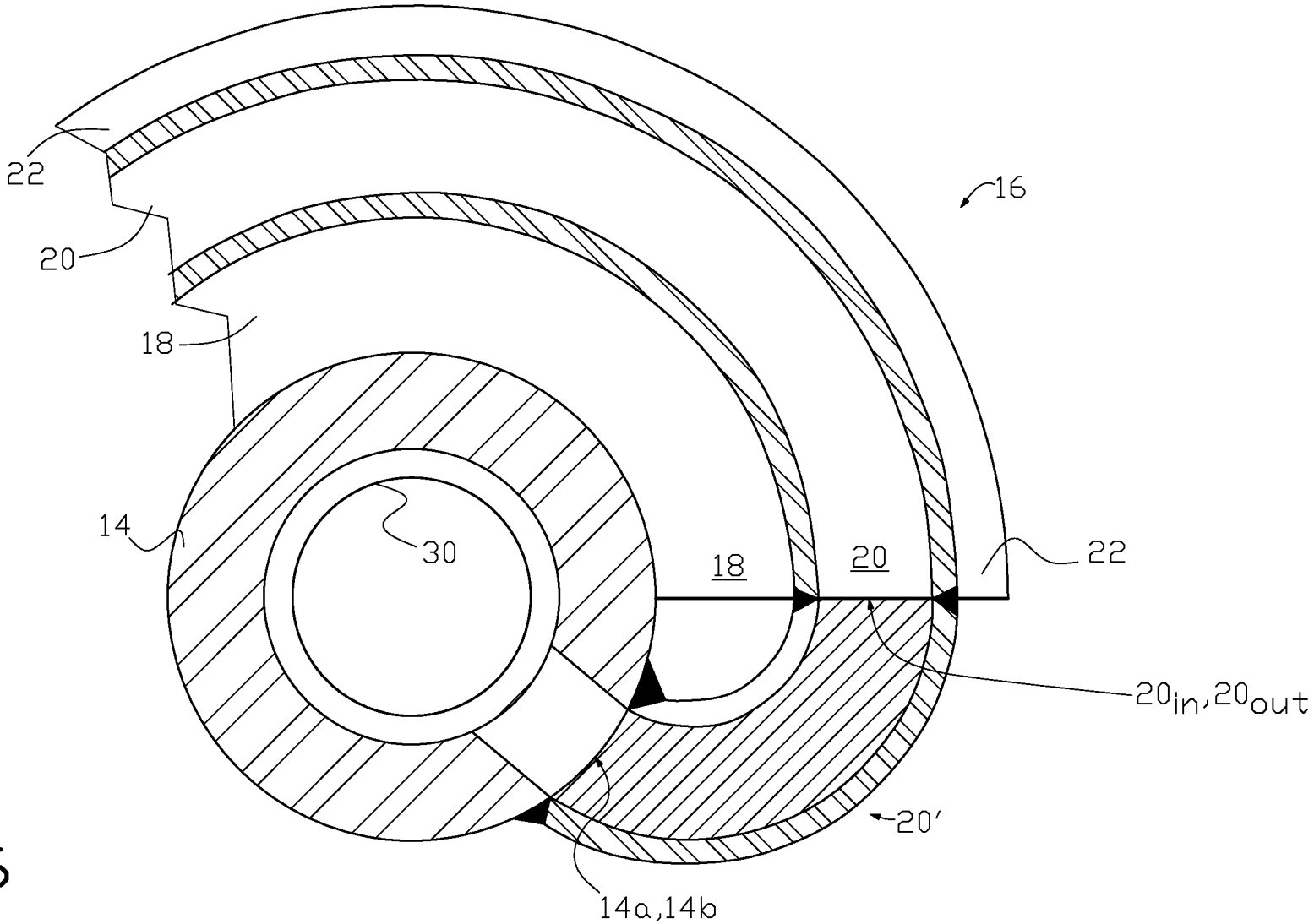
FIG. 6 is a partial cross sectional elevation view perpendicular to the longitudinal axis of a furnace roller assembly illustrating one example of a coolant flow passage interface between the shaft and the cooling element associated with a shaft-offset and metal product contact surface assembly.

FIG. 4 and FIG. 6 illustrate one example of the above described coolant flow. In FIG. 4 coolant supply conduit 32 supplies the coolant to the interior of corebuster 30 at the left axial end of shaft 14. In corebuster segment 30*a* coolant flows from left to right within the corebuster until it reaches baffle plate 80*a*, as indicated by the representative flow arrows within the interior of the corebuster. At baffle plate 80*a*, one or more flow passages 70*a* (shown as circular in this particular example) are radially distributed around the diameter of the corebuster and transition the coolant flow to the volume between the outer diameter of corebuster 30 and inner diameter of shaft 14 ("inter-volume"), with coolant continuing to flow from left to right, as indicated by the flow arrows in corebuster segment 30*b*, due to the presence of sealing ring 82*a* in the inter-volume. The coolant reenters the interior of the corebuster to the right of baffle plate 80*b* via one or more flow passages 70*b* that are radially distributed around the diameter of corebuster 30 to the right of baffle plate 80*b* and the presence of inter-volume sealing ring 82*b* to the right of passages 70*b* where it continues to flow from left to right in corebuster section 30*c* until it reaches the right axial end of the corebuster and then reenters the inter-volume via one or more flow passages 70*c* at the right axial end. At this point the coolant reverses direction and flows through the inter-volume until it reaches inlet $\mathbf{20}_{in}$ of cooling element 20 where it flows through cooling element 20 associated with the shaft-offset and metal product contact surface assembly, and exits the assembly at outlet $\mathbf{20}_{out}$ of cooling element 20 into the inter-volume, and then out through a suitable flow passage from shaft 14, such as annular opening 70*d* around coolant supply conduit 32.

While a single continuous shaft-offset and metal product contact surface assembly is helically wound around the outer surface of the shaft in the above examples of the invention, in other examples of the invention, two or more separate shaft-offset and metal product contact surface assemblies may be used.

FIG. 6 illustrates the coolant flow interface between the inter-volume and a cooling element inlet or outlet. In this particular example, transition cooling element (elbow) section 20' (shown crosshatched in the figure) is used as an interface coolant passage between offset assembly supply and return coolant openings (14*a* and 14*b*) on shaft 14, and the inlet and outlet of cooling element 20 to accommodate the large radius cooling element bends at these interfaces. The transition cooling element elbow section can be suitably welded around shaft coolant outlet 14*a* or inlet 14*b*, and the associated end of the coolant element. In some examples of the invention the inlet or outlet transition cooling element section may be integrally formed with the cooling element of the shaft-offset and metal product contact surface assembly.

In some examples of the invention, thermal insulation 40, for example a refractory, can optionally be provided at least around the outer surface of shaft 14 to minimize furnace heat loss to the relatively low temperature shaft as shown in FIG. 3(*b*). While insulation 40 is shown in FIG. 3(*b*) over support element 18 and cooling element 20, in other examples of the invention thermal insulation may be utilized selectively over the outer surface of the shaft; the support element and/or the cooling element.

The above examples of the invention have been provided merely for the purpose of explanation and are in no way to be construed as limiting of the present invention. While the invention has been described with reference to various embodiments, the words used herein are words of description and illustration, rather than words of limitations. Although the invention has been described herein with reference to particular means, materials and embodiments, the invention is not intended to be limited to the particulars disclosed herein; rather, the invention extends to all functionally equivalent structures, methods and uses. Those skilled in the art, having the benefit of the teachings of this specification, may effect numerous modifications thereto, and changes may be made without departing from the scope of the invention in its aspects.

The invention claimed is:

1. A furnace roller assembly comprising:

a furnace roller shaft having an outer surface;

at least one shaft-offset and metal product contact surface assembly helically wound around the outer surface of the furnace roller shaft extending in an axial direction along a length of the furnace roller shaft, the at least one shaft-offset and metal product contact surface assembly comprising:

a wear element;

a cooling element connected to the wear element, the cooling element having an internal coolant passage terminating at opposing cooling element supply and return ends at an offset assembly supply and return coolant openings, respectively, located along the length of the furnace roller shaft; and an elongated planar support plate between the outer surface of the furnace roller shaft and the cooling element to radially offset the cooling element and the wear element from the outer surface of the furnace roller shaft, wherein the support plate includes a first planar edge connected to outer surface of the furnace roller shaft so that the plane of the support plate extends radially from the outer surface of the furnace roller shaft and a second planar edge connected to the cooling element, wherein the second planar edge is on a side of the support plate opposite to the first planar edge.

2. The furnace roller assembly of claim 1 wherein the at least one shaft-offset and metal product contact surface assembly is counter wound about a central location on the outer surface of the furnace roller shaft towards opposing axial ends of the furnace roller shaft.

3. The furnace roller assembly of claim 2 further comprising a drive connected to at least one end of the furnace roller shaft to rotate the furnace roller shaft and the at least one shaft-offset and metal product contact surface assembly.

4. The furnace roller assembly of claim 1 wherein the cooling element comprises a tubular element.

5. The furnace roller assembly of claim 4 wherein the wear element comprises a planar wear bar, the wear bar connected to the cooling element so that a planar surface of the wear bar is radially offset from the outer surface of the furnace roller bar.

6. The furnace roller assembly of claim 1 wherein the planar support plate, cooling element and wear element are integrally cast.

7. The furnace roller assembly of claim 1 wherein the cooling element and wear element are integrally formed.

8. The furnace roller assembly of claim 1 further comprising a thermal insulation disposed over at least a portion of the outer surface of the furnace roller shaft.

9. The furnace roller assembly of claim 1 further comprising:

a corebuster located within the furnace roller shaft, the corebuster radially positioned relative to the interior surface of the furnace roller shaft to form a generally annular inter-volume between the outer surface of the corebuster and the inner surface of the furnace roller shaft;

a coolant flow path having a shaft coolant inlet and outlet at a first axial end of the furnace roller shaft, the coolant flow path having a continuous coolant supply passage along the axial length of the furnace roller shaft in a first axial direction in communication with a continuous coolant return passage along the axial length of the furnace roller shaft in a second axial direction opposite the first axial direction, the continuous coolant supply passage along the axial length of the furnace roller shaft in the first axial direction comprising:

a first coolant supply passage segment within the interior of the corebuster extending from the shaft coolant inlet to a first transition located radially adjacent to the offset assembly return coolant opening and isolated from the offset assembly return coolant opening;

second coolant supply passage segment within the annular inter-volume extending from the first transition to a second transition located radially adjacent to the offset assembly supply coolant opening and isolated from the offset assembly supply coolant opening; and a third coolant supply passage segment within the interior of the corebuster extending from the second transition to the axial end of the furnace roller shaft opposing the first axial end of the furnace roller shaft;

the continuous coolant return passage along the axial length of the furnace roller shaft in the second axial direction comprising:

a first coolant return passage segment within the annular inter-volume extending from the axial end of the furnace roller shaft opposing the first axial end of the furnace roller shaft to the offset assembly supply coolant opening;

a second coolant return passage segment within the internal coolant passage of the cooling element and extending from the cooling element supply end to the cooling element return end; and a third coolant return passage segment within the annular inter-volume extending from the offset assembly return coolant opening to the shaft coolant outlet.

10. The furnace roller assembly of claim 9 further comprising a thermal insulation disposed over at least a portion of the outer surface of the furnace roller shaft.

11. A furnace roller assembly comprising:

a furnace roller shaft having an outer surface;

at least one shaft-offset and metal product contact surface assembly helically wound around the outer surface of the furnace roller shaft extending in an axial direction along a length of the furnace roller shaft, the at least one shaft-offset and metal product contact surface assembly comprising;

a wear element;

a cooling element connected to the wear element having an internal coolant passage terminating at opposing cooling element supply and return ends at an offset assembly supply and return coolant openings, respectively, located along the length of the furnace roller shaft; and an elongated inverted V-shape element between the outer surface of the furnace roller shaft and the cooling element to radically offset the cooling element and the wear element from the other surface of the furnace roller shaft, wherein the diverging extended ends of the legs of the inverted V-shaped element are connected to the outer surface of the furnace roller shaft and the converging ends of the legs of the inverted V-shaped element are connected to the cooling element.

12. The furnace roller assembly of claim 11 wherein the at least one shaft-offset and metal product contact surface assembly is counter wound about a central location on the outer surface of the furnace roller shaft towards opposing axial ends of the furnace roller shaft.

13. The furnace roller assembly of claim 12 further comprising a drive connected to at least one end of the furnace roller shaft to rotate the furnace roller shaft and the at least one shaft-offset and metal product contact surface assembly.

14. The furnace roller assembly of claim 11 wherein the cooling element comprises a tubular element.

15. The furnace roller assembly of claim 11 wherein the wear element comprises a planar wear bar, the wear bar connected to the cooling element so that a planar surface of the wear bar is radially offset from the outer surface of the furnace roller bar.

16. The furnace roller assembly of claim 11 wherein the planar support plate, cooling element and wear element are integrally cast.

17. The furnace roller assembly of claim 11 wherein the cooling element and wear element are integrally formed.

18. The furnace roller assembly of claim 11 further comprising a thermal insulation disposed over at least a portion of the outer surface of the furnace roller shaft.

19. The furnace roller assembly of claim 11 further comprising:

a corebuster located within the furnace roller shaft, the corebuster radially positioned relative to the interior surface of the furnace roller shaft to form a generally annular inter-volume between the outer surface of the corebuster and the inner surface of the furnace roller shaft;

a coolant flow path having a shaft coolant inlet and outlet at a first axial end of the furnace roller shaft, the coolant flow path having a continuous coolant supply passage along the axial length of the furnace roller shaft in a first axial direction in communication with a continuous coolant return passage along the axial length of the furnace roller shaft in a second axial direction opposite the first axial direction, the continuous coolant supply passage along the axial length of the furnace roller shaft in the first axial direction comprising:

a first coolant supply passage segment within the interior of the corebuster extending from the shaft coolant inlet to a first transition located radially adjacent to the offset assembly return coolant opening and isolated from the offset assembly return coolant opening;

second coolant supply passage segment within the annular inter-volume extending from the first transition to a second transition located radially adjacent to the offset assembly supply coolant opening and isolated from the offset assembly supply coolant opening; and a third coolant supply passage segment within the interior of the corebuster extending from the second transition to the axial end of the furnace roller shaft opposing the first axial end of the furnace roller shaft;

the continuous coolant return passage along the axial length of the furnace roller shaft in the second axial direction comprising:

a first coolant return passage segment within the annular inter-volume extending from the axial end of the furnace roller shaft opposing the first axial end of the furnace roller shaft to the offset assembly supply coolant opening;

a second coolant return passage segment within the internal coolant passage of the cooling element and extending from the cooling element supply end to the cooling element return end; and a third coolant return passage segment within the annular inter-volume extending from the offset assembly return coolant opening to the shaft coolant outlet.

20. A shaft-offset and metal product contact surface assembly configured to be wound around a furnace roller shaft comprising:

a wear element;

a cooling element connected to the wear element, the cooling element having an internal coolant passage terminating at opposing cooling element supply and return ends at an offset assembly supply and return coolant openings, respectively, located along the furnace roller shaft; and a support plate between the outer surface of the furnace roller shaft and the cooling element to radially offset the cooling element and the wear element from the outer surface of the furnace roller shaft, wherein the support plate includes a first planar edge connected to the outer surface of the furnace roll shaft so that the plane of the support plate extends radially from the outer surface of the furnance roller shaft and a second planar edge connected to the cooling element, wherein the second planar edge is in a side of the support plate opposite to the first planar edge.

21. The shaft-offset and metal product contact surface assembly of claim 20 wherein the cooling element comprises a tubular element.

22. The shaft-offset and metal product contact surface assembly of claim 20 wherein the wear element comprises a planar wear bar, the wear bar connected to the cooling element so that a planar surface of the wear bar is radially offset from the outer surface of the furnace roller bar.

23. A shaft-offset and metal product contact surface assembly configured to be wound around a furnace roller shaft comprising:

a wear element;

a cooling element connected to the wear element, the coolig element having an internal ccolant passage terminating at opposing cooling element supply and return ends at an offset assembly supply and return coolant openings, respectively, located along the furnace roller shaft; and an elongated inverted V-shape element connectable between the outer surface of the furnace roller shaft and the cooling element to radially offset the cooling element and the wear element from the outer surface of the furnace rller shaft, wherein the diverging extended ends of the legs of the inverted V-shaped element are connected to the outer surface of the furnace roller shaft and the converging ends of the legs of the inverted V-shaped element are connected to the cooling element.

24. The shaft-offset and metal product contact surface assembly of claim 23 wherein the cooling element comprises a tubular element.

25. The shaft-offset and metal product contact surface assembly of claim 23 wherein the wear element comprises a planar wear bar, the wear bar connected to the cooling element so that a planar surface of the wear bar is radially offset from the outer surface of the furnace roller bar.

* * * * *